US009987731B2

(12) United States Patent
Chuang

(10) Patent No.: US 9,987,731 B2
(45) Date of Patent: Jun. 5, 2018

(54) BLEEDER FITTING STRUCTURE

(71) Applicant: Chia-Chiung Chuang, Taichung (TW)

(72) Inventor: Chia-Chiung Chuang, Taichung (TW)

( * ) Notice: Subject to any disclaimer, the term of this patent is extended or adjusted under 35 U.S.C. 154(b) by 299 days.

(21) Appl. No.: 14/972,024

(22) Filed: Dec. 16, 2015

(65) Prior Publication Data

US 2017/0173767 A1 Jun. 22, 2017

(51) Int. Cl.
*B25B 23/10* (2006.01)
*B25B 13/06* (2006.01)
*B25B 13/48* (2006.01)

(52) U.S. Cl.
CPC ..... *B25B 23/108* (2013.01); *B25B 13/065* (2013.01); *B25B 13/48* (2013.01)

(58) Field of Classification Search
CPC ..... B25B 23/108; B25B 13/056; B25B 13/48; B60T 17/221
USPC ..... 137/198, 199; 188/352
See application file for complete search history.

(56) References Cited

U.S. PATENT DOCUMENTS 3,301,282 A † 1/1967 Fresolone, Jr.
3,809,359 A † 5/1974 Truelove
4,905,731 A * 3/1990 Tamashiro ..... B25B 13/48 116/276
5,301,575 A * 4/1994 Mehlau ..... B60T 17/222 188/352
6,334,459 B1 * 1/2002 Berger ..... B60T 17/221 137/198
2003/0094591 A1 † 5/2003 Rafko
2011/0314974 A1 * 12/2011 Lan ..... B25B 13/483 81/177.6

FOREIGN PATENT DOCUMENTS

TW I496708 B † 8/2015

* cited by examiner
† cited by third party

*Primary Examiner* — David B Thomas
(74) *Attorney, Agent, or Firm* — Guice Patents PLLC

(57) ABSTRACT

A bleeder fitting structure includes a rigid first fitting member for rotating the bleeder and an elastic second fitting member connectable with the bleeder to form a flow passage. A deformation space with a certain size is defined between the first and second fitting members, whereby when the second fitting member is connected with the connection ends of different bleeders with different sizes, the second fitting member is deformed to different extents. Therefore, the second fitting member can be tightly fitted with the connection ends of different bleeders with a larger range of size to ensure that the fluid can flow through the flow passage without leakage.

9 Claims, 9 Drawing Sheets

BLEEDER FITTING STRUCTURE

BACKGROUND OF THE INVENTION

1. Field of the Invention

The present invention relates generally to a hand tool, and more particularly to a bleeder fitting structure.

2. Description of the Related Art

FIG. 1 shows a conventional bleeder 1, which is generally used as a connection member of a closed hydraulic circuit such as a hydraulic brake system for connecting with outer side. The bleeder 1 enables a user to conveniently replace the fluid in the circuit. In use, it is necessary to rotate the bleeder 1 so as to communicate the inlet passage 1*a* of the bleeder 1 with the hydraulic circuit or discommunicate the inlet passage 1*a* from the hydraulic circuit. Also, it is necessary to connect a proper connection pipeline with the tapered connection end 1*b* of the bleeder 1 so that the connection pipeline can connect with the hydraulic circuit via the bleeder 1.

In order to facilitate the above operation, a conventional fitting tool 2 has been disclosed as shown in FIGS. 2 and 3. With the fitting tool 2, a user can apply a rotating force to the bleeder 1 and connect the fitting tool 2 with the connection end 1*b* at the same time. Please further refer to FIG. 1. The fitting tool 2 has a metal-made hollow socket 2*a* for fitting on a nut 1*c* positioned on inner side of the connection end 1*b* of the bleeder 1 so as to apply a rotational force to the bleeder 1 to rotate the bleeder 1. A flexible elastic sleeve 2*b* is coaxially inlaid in the hollow socket 2*a* to form a radially expandable and restorable elastic connection opening for tightly fitting on the connection end 1*b* as a passage in communication with the external connection pipeline.

Such fitting tool 2 enables a user to easily operate the bleeder 1. However, there are various conventional bleeders with different structures or sizes are employed in different hydraulic circuits in accordance with the requirements thereof. Only when the fitting tool 2 can be fitted on the nut of a bleeder and tightly connected with the connection end of the bleeder, the fitting tool 2 can be applied to the bleeder to replace the fluid in the hydraulic circuit. However, in the existent industrial product standards, there is not yet any suitable standard to follow. Therefore, there are various bleeders with different sizes or configurations of connection ends exist in this field at the same. In this case, due to the limitation of its own structure, the fitting tool 2 can be only applied to the connection ends of the bleeders with a smaller range of size to rotate and connect with the connection ends.

Substantially, the flexible elastic sleeve 2*b* of the fitting tool 2 serves as a fitting structure for connecting with the connection end 1*b* of the bleeder. However, the fitting tool 2 is such limited that the flexible elastic sleeve 2*b* can be only deformed to an extent within a small range due to its own material properties. With respect to the connection ends of the conventional bleeders with different sizes or configurations, the fitting tool 2 cannot be applied to different bleeders with different connection ends the size or configuration of which widely ranges. As a result, the application range of the fitting tool 2 is limited and a user cannot conveniently use the fitting tool 2.

SUMMARY OF THE INVENTION

It is therefore a primary object of the present invention to provide a bleeder fitting structure, which is applicable to different bleeders with different sizes within a large range. The bleeder fitting structure can be tightly fitted on the different bleeders to facilitate the operation of a user. Moreover, the requirement for different sizes of tools or equipments can be reduced to lower the burden.

To achieve the above and other objects, the bleeder fitting structure of the present invention follows the conventional double fitting technique by which a user can apply a rotating force to the nut of the bleeder and connect the fitting structure with the connection end of the bleeder at the same time. The present invention is characterized in that the different fitting members for the double fitting are spaced from each other by a certain gap to form a deformation space, which permits the fitting member to deform or displace to a greater extent. Accordingly, a tool or equipment with the bleeder fitting structure of the present invention is applicable to different bleeders with different sizes within a large range and tightly fitted on the different bleeders.

To speak more specifically, the bleeder fitting structure of the present invention includes a rigid first fitting member having a first body section, a receiving space formed in the first body section and an open first fitting socket formed on the first body section in communication with the receiving space; and an elastic second fitting member for fitting with the tapered connection end of the bleeder. The second fitting member has a second body section received in the receiving space. An outer circumference of the second body section faces an inner circumferential wall of the receiving space. A flowing space is formed in the second body section. A second fitting socket is formed on the second body section in communication with the flowing space. The bleeder fitting structure is characterized in that the bleeder fitting structure further includes a deformation space defined between the second body section and the first body section. The deformation space permits the second fitting member to deform or displace to a certain extent, whereby the configuration or position of the second body section is changeable within the deformation space.

In the above bleeder fitting structure, the deformation of the second body section is not limited to non-eccentric deformation. Therefore, it is unnecessary to limit the position, size or configuration of the deformation space.

However, in order to achieve uniform deformation, the deformation space can have an annular or tubular form and the curvature center of the deformation space coincides with an axis of the second fitting socket. Accordingly, when the second fitting socket of the second fitting member is fitted on and connected with the connection end of the bleeder, the deformation or displacement of the second fitting member takes place from the connection end of the bleeder as a center to the surrounding of the connection end of the bleeder.

In addition, with the above conventional fitting tool taken as an example, the deformation space is formed in such a manner that the inner wall of the socket is partially milled off by a certain depth and/or the outer wall of the elastic sleeve is partially milled off by a certain depth.

That is, the second fitting member further has a rib formed on the outer circumference of the second body section. A free end of the rib abuts against the inner circumferential wall of the receiving space. Accordingly, the outer circumference of the second body section is spaced from the inner circumferential wall of the receiving space and the deformation space is defined between the outer circumference of the second body section and the inner circumferential wall of the receiving space.

In the above bleeder fitting structure, preferably, the rib has an annular form and is coaxial with the second fitting socket.

Alternatively, the first fitting member further has a groove formed on the inner circumferential wall of the receiving space. Accordingly, the deformation space is defined between a bottom section of the groove and the outer circumference of the second body section.

Preferably, the groove is an annular groove coaxial with the first fitting socket.

The present invention can be best understood through the following description and accompanying drawings, wherein:

DETAILED DESCRIPTION OF THE PREFERRED EMBODIMENTS

Figure 1:
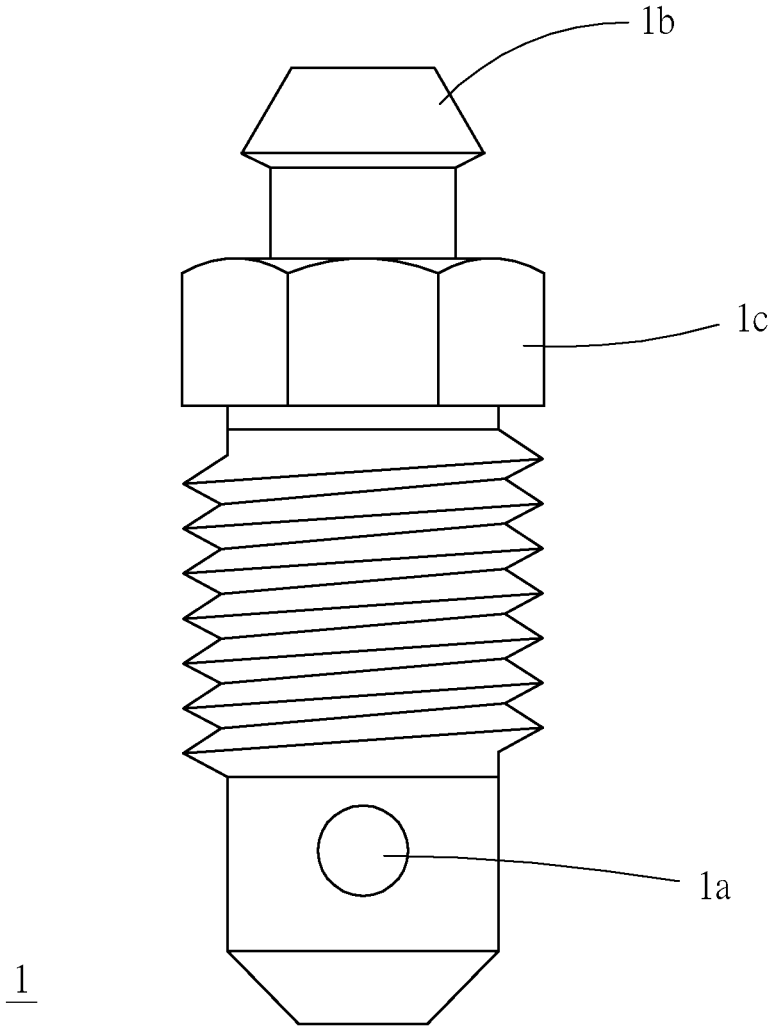
Fig. 1 PRIOR ART
FIG. 1 is a perspective view of a conventional bleeder.

Please refer to FIGS. 4 to 7. According to a first embodiment, the bleeder fitting structure 10 of the present invention includes a first fitting member 20, a second fitting member 30 and a deformation space 40.

The first fitting member 20 is a rigid member made of suitable metal material. The first fitting member 20 has a cylindrical first body section 21, a receiving space 22 inward axially extending from one end of the first body section 21 by a certain depth and an open first fitting socket 23 with a polygonal socket wall. The first fitting socket 23 inward axially extends from the other end of the first body section 21 to communicate with the receiving space 22.

The second fitting member 30 is an elastic member made of a flexible material such rubber. The second fitting member 30 is received in the receiving space 22. The second fitting member 30 has a cylindrical second body section 31. An outer circumference of the second body section 31 faces an inner circumferential wall of the receiving space 22. An annular rib 32 is formed on the outer circumference of the second body section 31 by a certain height. A free end of the annular rib 32 abuts against the corresponding inner circumferential wall of the receiving space 22. Accordingly, the outer circumference of the second body section 31 is spaced from the corresponding inner circumferential wall of the receiving space 22. A flowing space 33 in the form of a passage inward axially extends from one end of the second body section 31. A second fitting socket 34 in the form of a circular hole is formed at the other end of the second body section 31 in communication with the flowing space 33.

The deformation space 40 has a tubular form and is defined between the outer circumference of the second body section 31 and the corresponding inner circumferential wall of the receiving space 22, which faces the outer circumference of the second body section 31.

Figure 8:
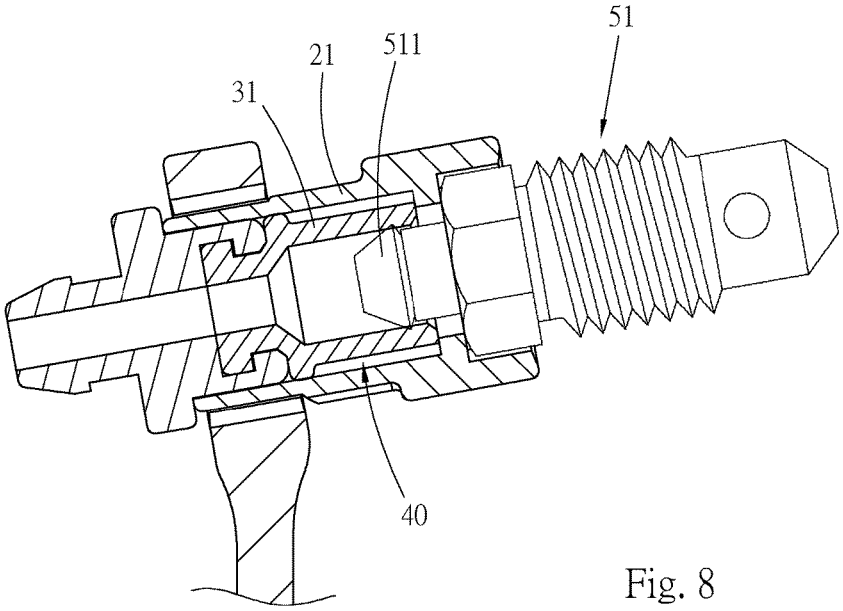
FIG. 8 is a sectional view showing that the first embodiment of the present invention is fitted on a bleeder with a small size.

Accordingly, when the second fitting socket 34 of the second fitting member 30 is fitted on the connection end of the bleeder, the second body section 31 can be correspondingly deformed or displaced within the space range provided by the deformation space 40 in accordance with the configuration and size of the connection end of different bleeders. In this case, the second body section 31 can be tightly connected with the connection end of the bleeder. To speak more specifically, further referring to FIG. 8, when the second fitting socket 34 of the second fitting member is fitted on the connection end 511 of a bleeder 51 with a smaller size, the second body section 31 is simply relatively slightly deformed without utilizing the space provided by the deformation space 40 for deformation or displacement. Such use state is similar to the conventional technique and the present invention has not yet brought out its function.

Figure 9:
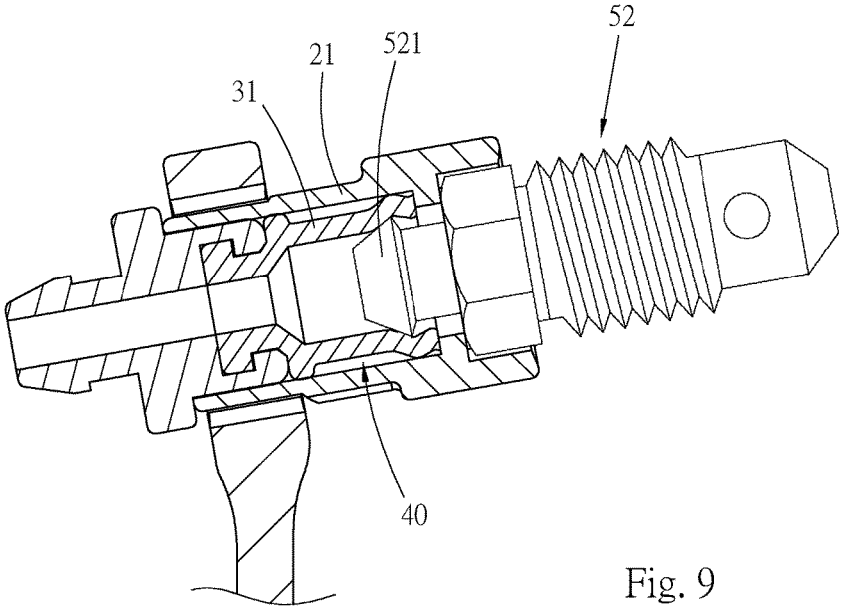
FIG. 9 is a sectional view showing that the first embodiment of the present invention is fitted on a bleeder with a large size.

However, when the second fitting socket 34 of the second fitting member is fitted on the connection end 521 of another bleeder 52 with a larger size, as shown in FIG. 9, the second body section 31 is deformed and displaced to a greater extent in accordance with the increased size of the connection end 521. At this time, the deformation space 40 allows the second body section 31 to deform in accordance with the connection end 521 so that the second body section 31 can be tightly connected with the connection end 521 of the bleeder 52 with the larger size.

Figure 2:
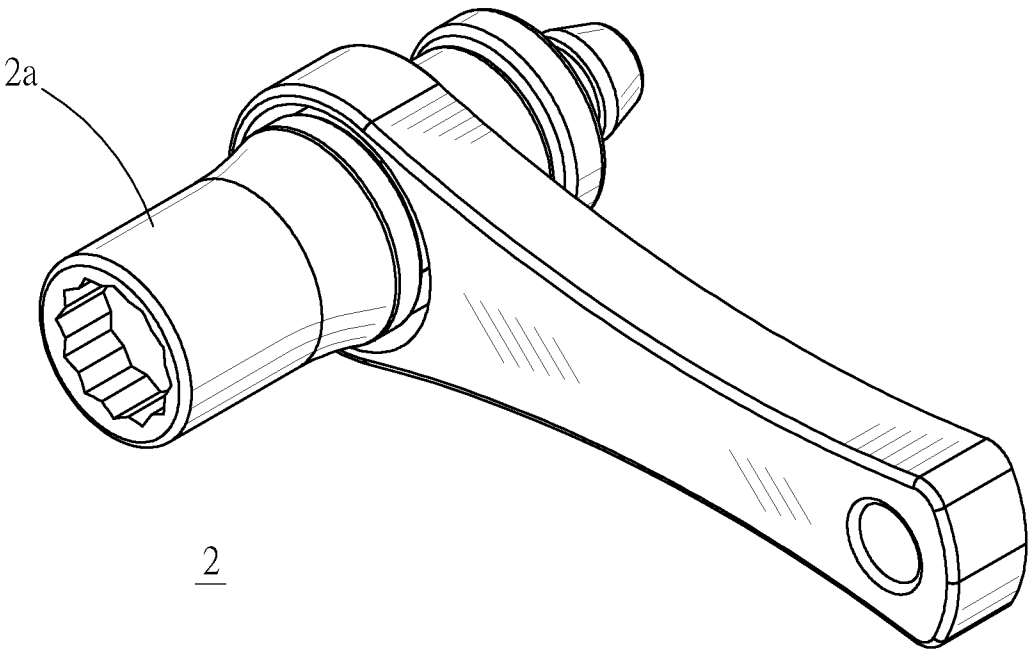
Fig. 2 PRIOR ART
FIG. 2 is a perspective view of a conventional fitting tool.
Figure 3:
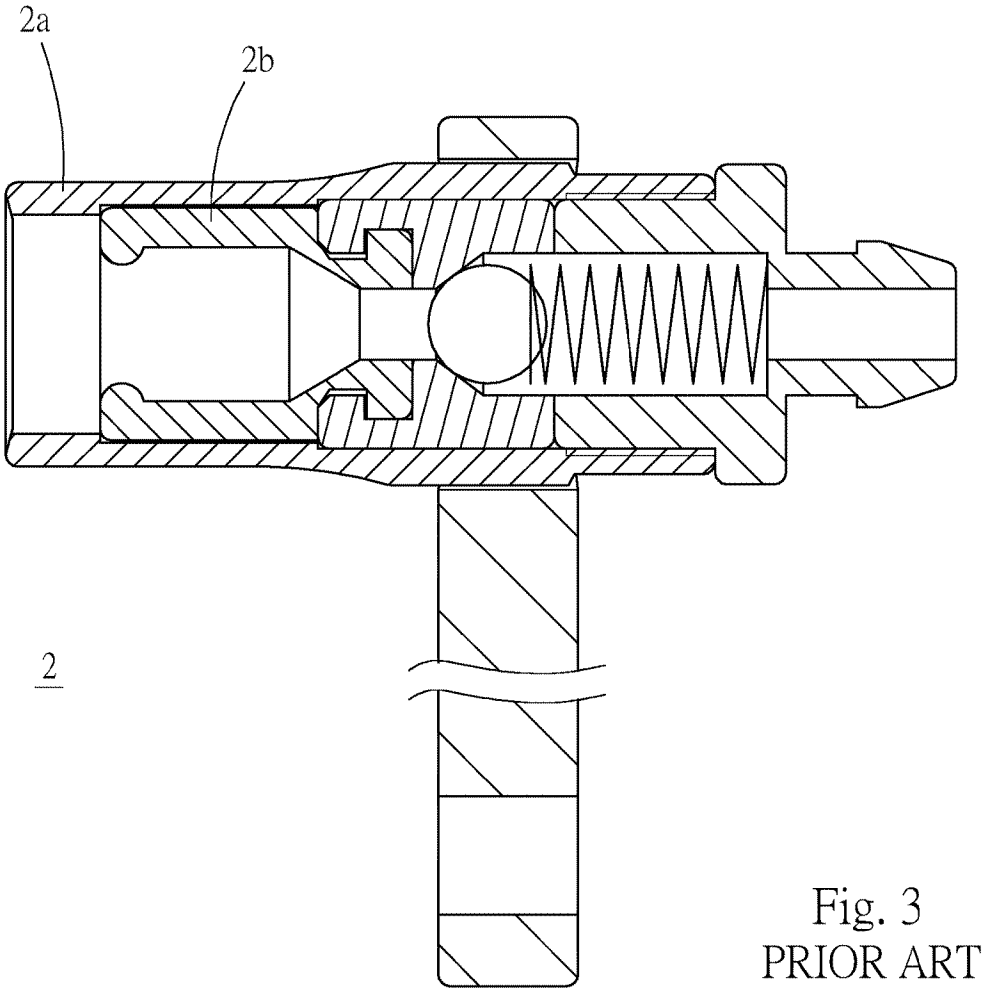
Fig. 3 PRIOR ART
FIG. 3 is a sectional view of the conventional fitting tool.
Figure 4:
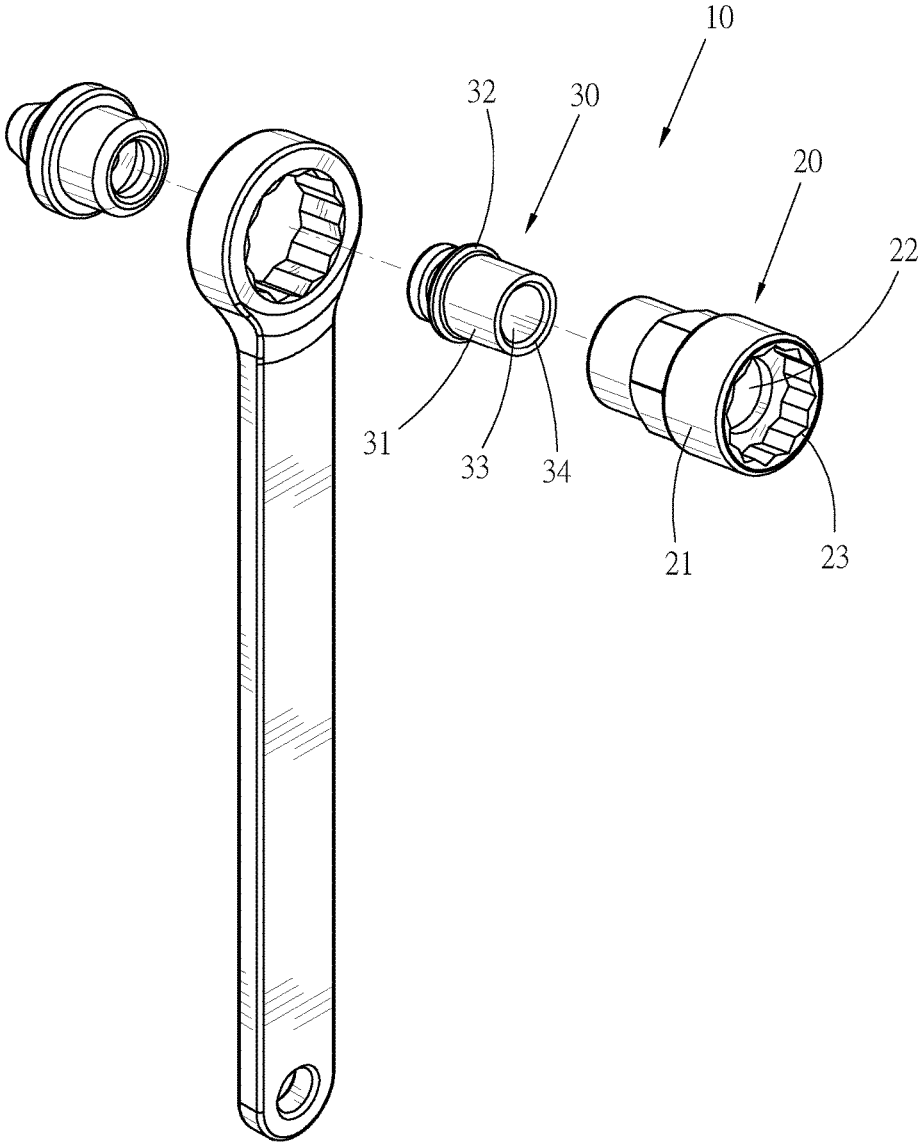
FIG. 4 is a perspective exploded view of a first embodiment of the present invention.
Figure 5:
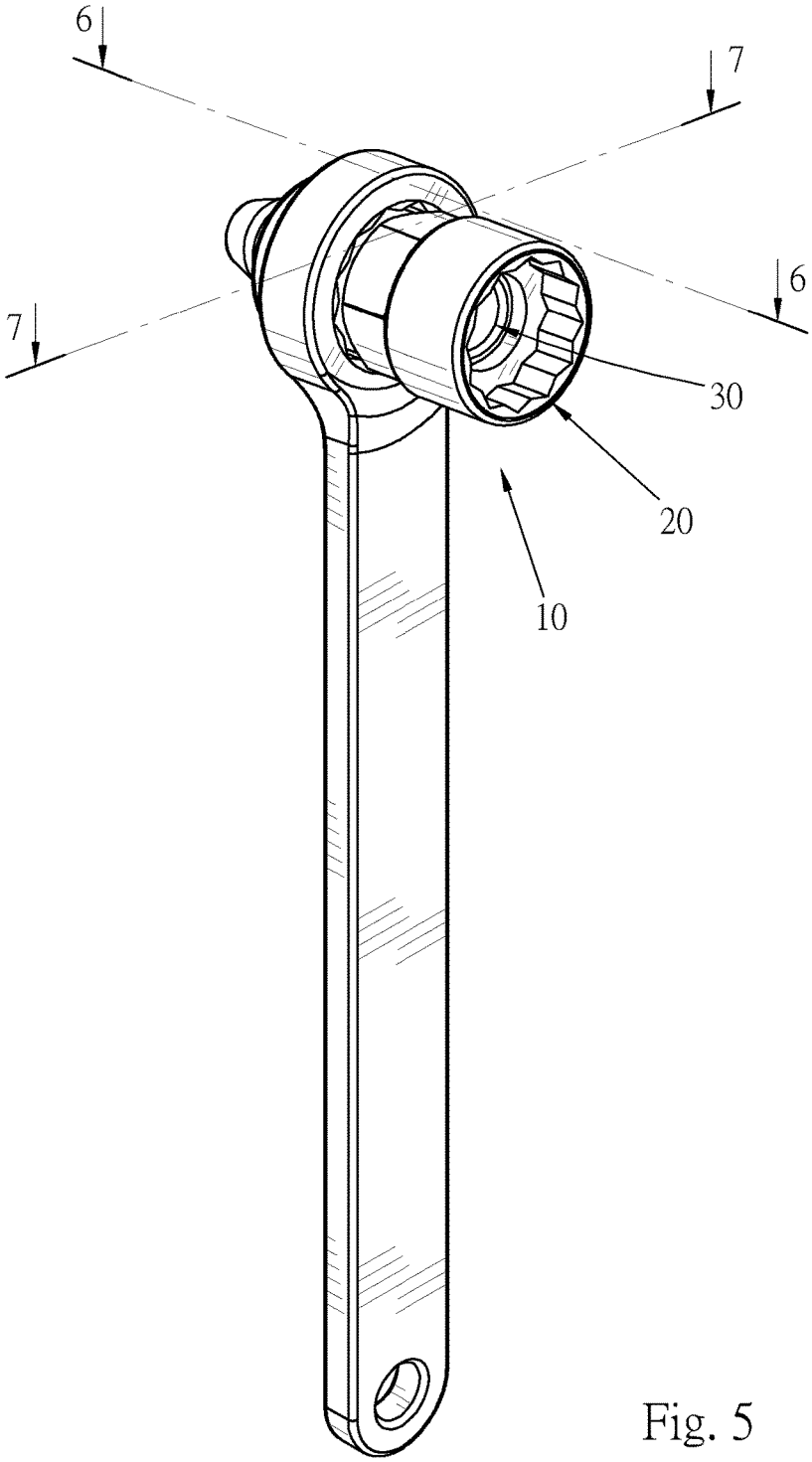
FIG. 5 is a perspective assembled view of the first embodiment of the present invention.
Figure 6:
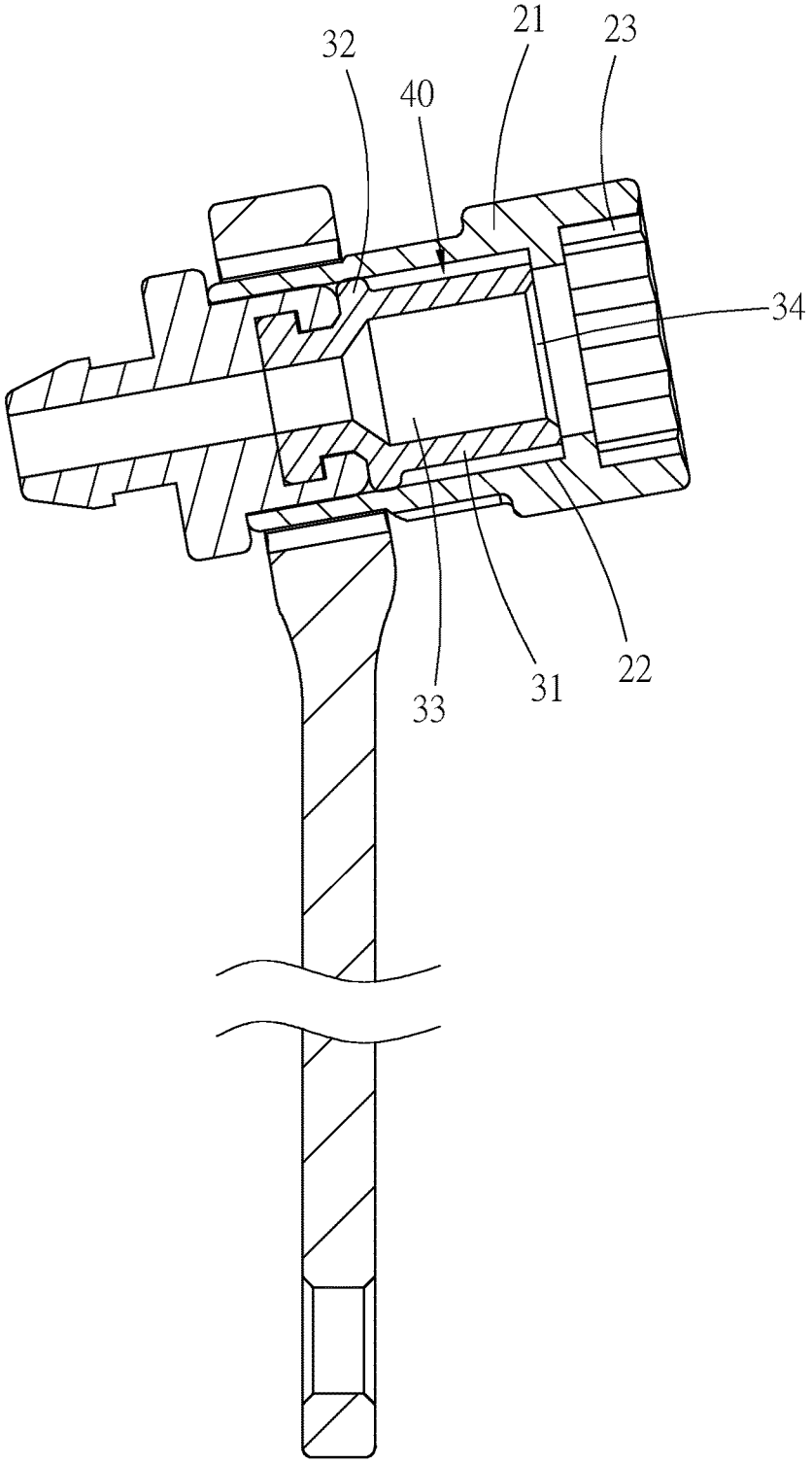
FIG. 6 is a sectional view of the first embodiment of the present invention, taken along line 6-6 of FIG. 5.
Figure 7:
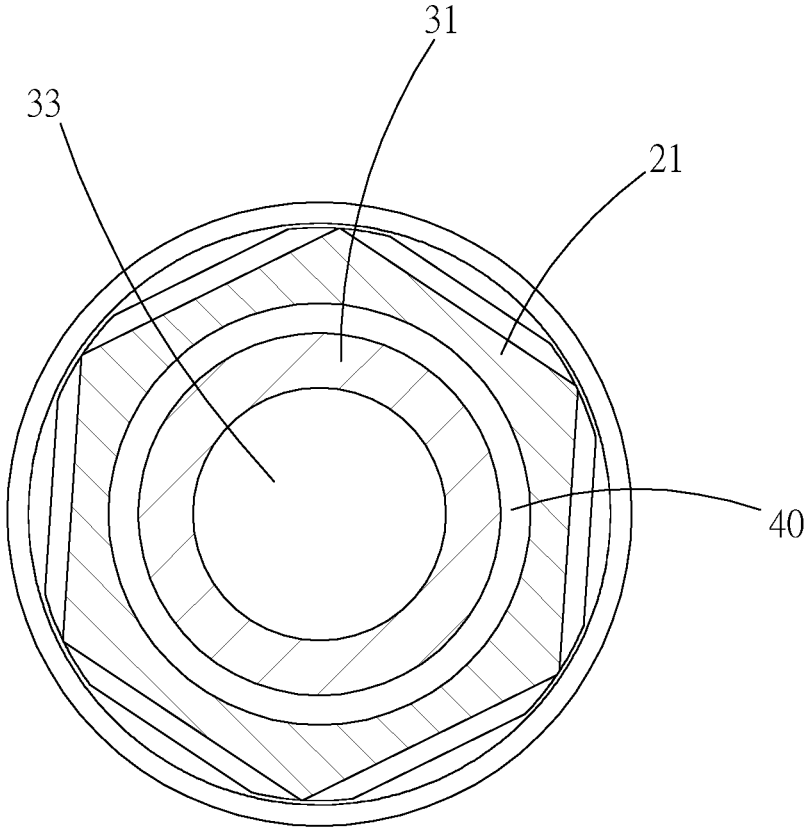
FIG. 7 is a sectional view of the first embodiment of the present invention, taken along line 7-7 of FIG. 5.

According to the above, in comparison with the conventional fitting tool as shown in FIGS. 2 and 3, with respect to the double bleeder fitting technique, the bleeder fitting structure 10 of the present invention is unchanged. However, by means of the structure of the deformation space 40, the range of the size of the bleeder connection end on which the second fitting member 30 can be fitted is greatly enlarged. Moreover, the second body section 31 is correspondingly deformable in adaptation to the configuration of the connection end of the bleeder. Therefore, the bleeder fitting structure of the present invention is applicable to various bleeders to fit on the connection ends thereof with a larger range or size or configuration change. Accordingly, the bleeder fitting structure of the present invention can be more conveniently operated.

Figure 10:
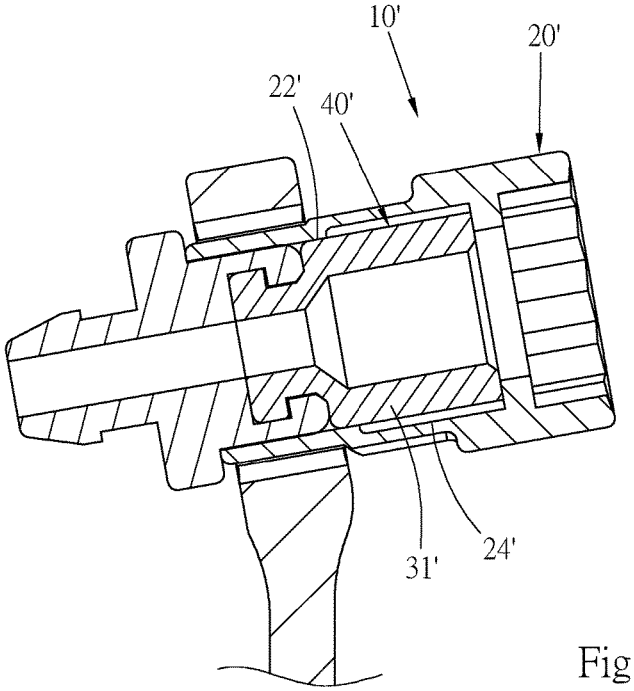
FIG. 10 is a sectional view of a second embodiment of the present invention.

It should be further noted that the present invention is characterized by the structure of the deformation space. The structure of the deformation space is not limited to what is disclosed in the first embodiment. Alternatively, as shown in FIG. 10, which shows a second embodiment of the present invention, the bleeder fitting structure 10' has a deformation space 40' provided by the first fitting member 20.

To speak more specifically, in this embodiment, the first fitting member 20' is further formed with an annular groove 24. The annular groove 24' is formed on the inner circumferential wall of the receiving space 22. The annular groove 24' has a position and size corresponding to those of a portion of the second body section 31' in adjacency to the second fitting socket 34. Accordingly, the outer circumference of the second body section 31' is spaced from the corresponding inner circumference of the first fitting member 20, which faces the outer circumference of the second body section 31'. (That is, the outer circumference of the second body section 31' is spaced from the bottom face of the annular groove 24'). This can achieve an equivalent effect as the effect achieved by the rib of the first embodiment. Accordingly, the deformation space 40' is interposed between the second body section 31' and the bottom face of the annular groove 24' and the bleeder fitting structure 10' can provide the same effect as the first embodiment.

Figure 11:
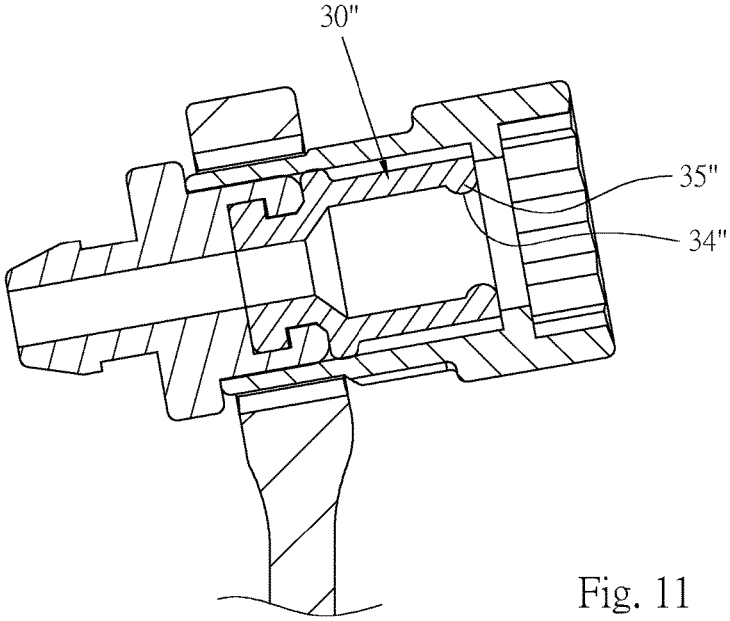
FIG. 11 is a sectional view of a third embodiment of the present invention.

In addition, in order to enhance the connection tightness between the bleeder connection end and the bleeder fitting structure, FIG. 11 shows a third embodiment of the present invention. In the third embodiment, the second fitting member 30" further has an annular engagement rib 35" formed on the inner circumferential wall of the second fitting socket 34". The annular engagement rib 35" is inlaid in the annular groove formed on inner side of the connection end of the bleeder. In this case, the bleeder fitting structure 10" can be more tightly connected with the bleeder.

The above embodiments are only used to illustrate the present invention, not intended to limit the scope thereof. Many modifications of the above embodiments can be made without departing from the spirit of the present invention.

What is claimed is:

1. A bleeder fitting structure comprising:

a first fitting member being rigid and having a first body section, a receiving space formed in the first body section and an open first fitting socket formed on the first body section in communication with the receiving space; and a second fitting member being elastic and having a second body the second fitting member has a length that is shorter than a length of the receiving space of the first fitting member and the second fitting member is located within the receiving space of the first fitting member, an outer circumference of the second body section facing an inner circumferential wall of the receiving space, a flowing space being formed in the second body section, a second fitting socket being formed on the second body section in communication with the flowing space, the second fitting member is positioned in the first fitting member wherein the second fitting socket of the second fitting member is spaced apart from and prevented from being inserted into the first fitting socket of the first fitting member, the bleeder fitting structure being characterized in that the bleeder fitting structure further comprises a deformation space defined between the second body section and the first body section, whereby the configuration or position of the second body section is changeable within the deformation space;

wherein the outer circumference of the second body section of the second fitting member has at least one engaging portion engaging the inner circumferential wall of the receiving space of the first fitting member and at least one portion spaced apart from the inner circumferential wall of the receiving space of the first fitting member.

2. The bleeder fitting structure as claimed in claim 1, wherein the deformation space has an annular form.

3. The bleeder fitting structure as claimed in claim 2, wherein the deformation space has a tubular form and an axial end of the deformation space is positioned where the second fitting socket is positioned.

4. The bleeder fitting structure as claimed in claim 3, wherein an axial end of the deformation space is positioned where the second fitting socket is positioned.

5. The bleeder fitting structure as claimed in claim 1, wherein the second fitting member further has a rib formed on the outer circumference of the second body section, a free end of the rib abutting against the inner circumferential wall of the receiving space.

6. The bleeder fitting structure as claimed in claim 5, wherein the rib has an annular form and a curvature center of the rib coincides with an axis of the second fitting socket.

7. The bleeder fitting structure as claimed in claim 6, wherein the rib is spaced from the second fitting socket.

8. The bleeder fitting structure as claimed in claim 1, wherein the first fitting member further has a groove formed on the inner circumferential wall of the receiving space, the deformation space being defined between a bottom section of the groove and the outer circumference of the second body section.

9. The bleeder fitting structure as claimed in claim 8, wherein the groove is an annular groove formed on the inner circumferential wall of the receiving space, the annular groove having an axis coinciding with an axis of the first fitting socket.

* * * * *